US012025129B2

(12) United States Patent
Chiba et al.

(10) Patent No.: US 12,025,129 B2
(45) Date of Patent: Jul. 2, 2024

(54) LIQUID SUPPLY TYPE SCREW COMPRESSOR

(71) Applicant: Hitachi Industrial Equipment Systems Co., Ltd., Tokyo (JP)

(72) Inventors: Kotaro Chiba, Tokyo (JP); Shigeyuki Yorikane, Tokyo (JP); Masahiko Takano, Tokyo (JP); Kenji Morita, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 17/798,832

(22) PCT Filed: Jan. 28, 2021

(86) PCT No.: PCT/JP2021/002980
§ 371 (c)(1),
(2) Date: Aug. 10, 2022

(87) PCT Pub. No.: WO2021/171889
PCT Pub. Date: Sep. 2, 2021

(65) Prior Publication Data

US 2023/0070782 A1 Mar. 9, 2023

(30) Foreign Application Priority Data

Feb. 25, 2020 (JP) ..... 2020-029262

(51) Int. Cl.
*F01C 1/16* (2006.01)
*F03C 2/00* (2006.01)
(Continued)

(52) U.S. Cl.
CPC ..... *F04C 18/16* (2013.01); *F04C 29/0007* (2013.01); *F04C 29/02* (2013.01);
(Continued)

(58) Field of Classification Search
CPC .. F04C 18/16; F04C 29/0007; F04C 29/0014; F04C 29/02; F04C 29/023; F04C 29/028; F04C 29/042; F04C 2250/20
See application file for complete search history.

(56) References Cited

U.S. PATENT DOCUMENTS

2013/0058822 A1 3/2013 Feller et al.
2019/0170143 A1* 6/2019 Chiba ..... F04C 29/0007

FOREIGN PATENT DOCUMENTS

CN 107829932 A * 3/2018 ..... F04C 18/16
EP 3 604 814 A1 2/2020
(Continued)

OTHER PUBLICATIONS

CN-107829932-A—Liu et al.—Screw Compressor, Air Conditioning Equipment And Its Volumetric Efficiency Regulating Method—Mar. 23, 2018—English Machine Translation. (Year: 2018).*
(Continued)

*Primary Examiner* — Theresa Trieu
(74) *Attorney, Agent, or Firm* — Crowell & Moring LLP

(57) ABSTRACT

A liquid-supply-type screw compressor can suppress a rise in temperature of a liquid while reducing work for stirring the liquid. The compressor has male and female rotors, male- and female-rotor-side working chambers formed at grooves of the male and female rotors, respectively. The compressor also has a liquid supply nozzle arranged on one side in the rotor axial direction which is a low-pressure side of an intersection at which a high-pressure-side cusp intersects a ridge line of a trailing lobe tip of the female rotor that
(Continued)

defines a female-rotor-side working chamber, the nozzle supplying liquid to the male-rotor-side working chamber; and a liquid-supply nozzle arranged on the other side in the rotor axial direction which is a high-pressure side of the intersection, and supplies the liquid to the male-rotor-side working chamber, and the liquid supply amount of the nozzle is made greater than the amount of the other liquid-supply nozzle.

6 Claims, 8 Drawing Sheets

(51) Int. Cl.

| | |
|---|---|
| ***F03C 4/00*** | (2006.01) |
| ***F04C 2/00*** | (2006.01) |
| ***F04C 18/16*** | (2006.01) |
| ***F04C 29/00*** | (2006.01) |
| ***F04C 29/02*** | (2006.01) |
| ***F04C 29/04*** | (2006.01) |

(52) U.S. Cl.
CPC ..... *F04C 29/04* (2013.01); *F04C 29/042* (2013.01); *F04C 2250/20* (2013.01)

(56) References Cited

FOREIGN PATENT DOCUMENTS

| | | | | |
|---|---|---|---|---|
| JP | 9-303279 | A | 11/1997 | |
| JP | 2001-153073 | A | 6/2001 | |
| JP | 2018-21494 | A | 2/2018 | |
| WO | WO 2018/173362 | A1 | 9/2018 | |
| WO | WO-2019044390 | A1 * | 3/2019 | ..... F04C 18/16 |
| WO | WO 2019/093109 | A1 | 5/2019 | |

OTHER PUBLICATIONS

WO-2019044390-A1—Chiba et al.—Screw Compressor—Mar. 7, 2019—English Machine Translation (Year: 2019).*

International Preliminary Report on Patentability (PCT/IB/338 & PCT/IB/373) issued in PCT Application No. PCT/JP2021/002980 dated Sep. 9, 2022, including English translation of document C2 (Japanese-language Written Opinion (PCT/ISA/237) filed on Aug. 10, 2022) (seven (7) pages).

International Search Report (PCT/ISA/210) issued in PCT Application No. PCT/JP2021/002980 dated Apr. 6, 2021 with English translation (five (5) pages).

Japanese-language Written Opinion (PCT/ISA/237) issued in PCT Application No. PCT/JP2021/002980 dated Apr. 6, 2021 (four (4) pages).

* cited by examiner

LIQUID SUPPLY TYPE SCREW COMPRESSOR

TECHNICAL FIELD

The present invention relates to a liquid supply type screw compressor that compresses a gas while supplying a liquid to working chambers.

BACKGROUND ART

Liquid supply type screw compressors compress a gas (specifically, air, for example) while supplying a liquid (specifically, an oil, for example) to working chambers formed at grooves of rotors. Purposes of the liquid supply are for cooling of the gas at a compression step, sealing of clearances of the working chambers, lubrication of the rotors, and the like.

A liquid supply type screw compressor in Patent Document 1 has: a male rotor and a female rotor that rotate while meshing with each other; a male-rotor-side bore that houses a lobe section of the male rotor; a female-rotor-side bore that houses a lobe section of the female rotor; a low-pressure-side cusp and a high-pressure-side cusp that are boundary lines between a wall surface of the male-rotor-side bore and a wall surface of the female-rotor-side bore; male-rotor-side working chambers that are formed at grooves of the male rotor, and compress a gas; and female-rotor-side working chambers that are formed at grooves of the female rotor, and compress the gas. The volumes of the male-rotor-side working chambers and the female-rotor-side working chambers change while the male-rotor-side working chambers and the female-rotor-side working chambers move from one side to the other side in the rotor axial direction along with rotation of the male rotor and the female rotor. Thereby, a suction step at which the gas is suctioned from a suction flow path via a suction port (opening), a compression step at which the gas is compressed, and a delivery step at which the compressed gas is delivered to a delivery flow path via a delivery port (opening) are performed sequentially.

In addition, the liquid supply type screw compressor in Patent Document 1 has a liquid supply nozzle that supplies a liquid to the male-rotor-side working chamber, and a liquid supply nozzle that supplies the liquid to the female-rotor-side working chamber. Each liquid supply nozzle supplies the liquid to the working chamber at the compression step. Stated differently, each liquid supply nozzle is arranged on one side in the rotor axial direction which is a low-pressure side of an intersection at which the high-pressure-side cusp intersects a ridge line of a trailing lobe tip of the female rotor that defines a female-rotor-side working chamber immediately after the start of delivery.

PRIOR ART DOCUMENT

Patent Document

Patent Document 1: JP-2001-153073-A

SUMMARY OF THE INVENTION

Problem to be Solved by the Invention

The liquid supply nozzles in Patent Document 1 supply the liquid to the working chambers at the compression step, and work for stirring the liquid (power loss) can be reduced if the liquid supply amounts are reduced. The work for stirring the liquid is work that occurs when the liquid supplied from the liquid supply nozzles moves in the rotor rotation directions for a reason such as adhesion to the rotors, thereafter is drawn into a portion where the male rotor and the female rotor mesh with each other, and is compressed. However, if the liquid supply amounts of the liquid supply nozzles are reduced, an amount of rise in temperature of the liquid increases. Accordingly, deterioration of the liquid is facilitated.

The present invention has been made in view of the matters described above, and one of objects of the present invention is to suppress a rise in temperature of a liquid while reducing work for stirring the liquid.

Means for Solving the Problem

In order to solve the problem described above, configuration described in CLAIMS is applied. The present invention includes a plurality of means for solving the problem described above, and an example of the present invention is a liquid supply type screw compressor including: a male rotor and a female rotor that rotate while meshing with each other; a male-rotor-side bore that houses a lobe section of the male rotor; a female-rotor-side bore that houses a lobe section of the female rotor; a low-pressure-side cusp and a high-pressure-side cusp that are boundary lines between a wall surface of the male-rotor-side bore and a wall surface of the female-rotor-side bore; male-rotor-side working chambers that are formed at grooves of the male rotor, and compress a gas; and female-rotor-side working chambers that are formed at grooves of the female rotor, and compress the gas, in which the liquid supply type screw compressor includes: a first liquid supply nozzle that is arranged on one side in a rotor axial direction, the one side being a low-pressure side of an intersection at which the high-pressure-side cusp intersects a ridge line of a trailing lobe tip of the female rotor, the ridge line defining a female-rotor-side working chamber immediately after a start of delivery, the first liquid supply nozzle supplying a liquid to either the male-rotor-side working chamber or the female-rotor-side working chamber; and a second liquid supply nozzle that is arranged on another side in the rotor axial direction, the other side being a high-pressure side of the intersection, and supplies the liquid to either the male-rotor-side working chamber or the female-rotor-side working chamber, and a liquid supply amount of the second liquid supply nozzle is made greater than a liquid supply amount of the first liquid supply nozzle.

Advantages of the Invention

According to the present invention, it is possible to suppress a rise in temperature of a liquid while reducing work for stirring the liquid.

Note that problems, configuration, and advantages other than those described above will be made clear by the following explanation.

MODES FOR CARRYING OUT THE INVENTION

Figure 1:
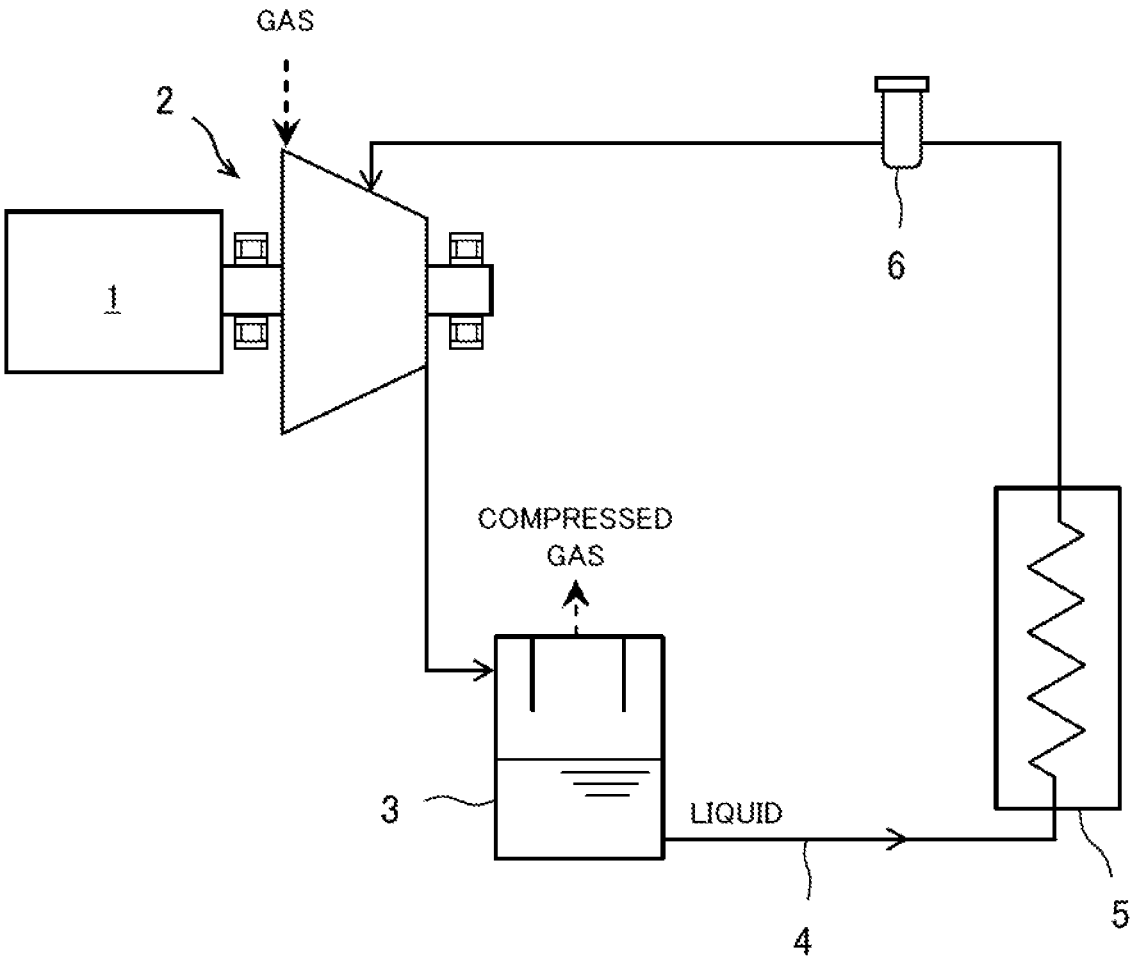
FIG. 1 is a schematic diagram depicting the configuration of a screw compressor in a first embodiment of the present invention.
Figure 2:
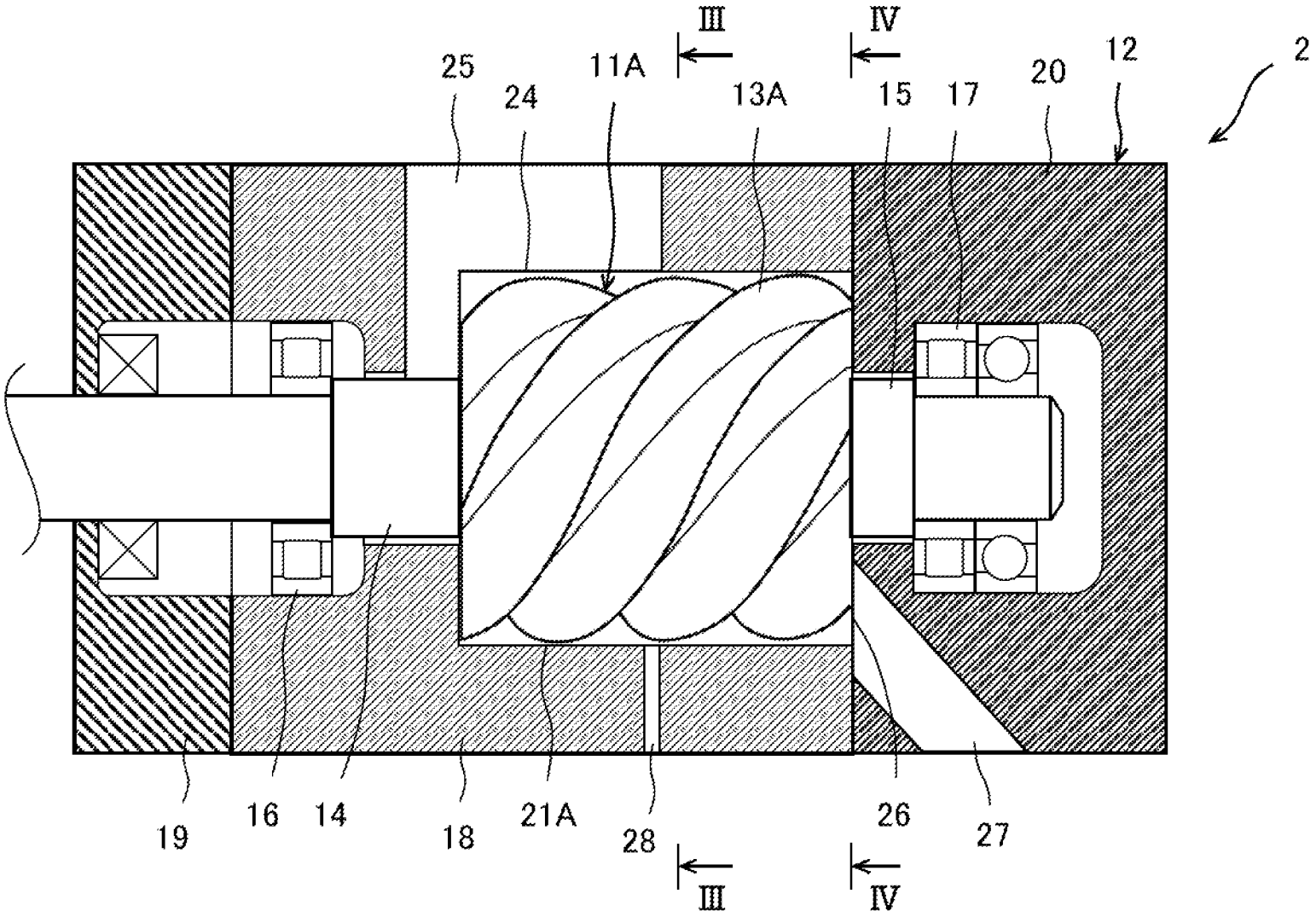
FIG. 2 is a vertical cross-sectional view depicting the structure of a compressor body in the first embodiment of the present invention.
Figure 3:
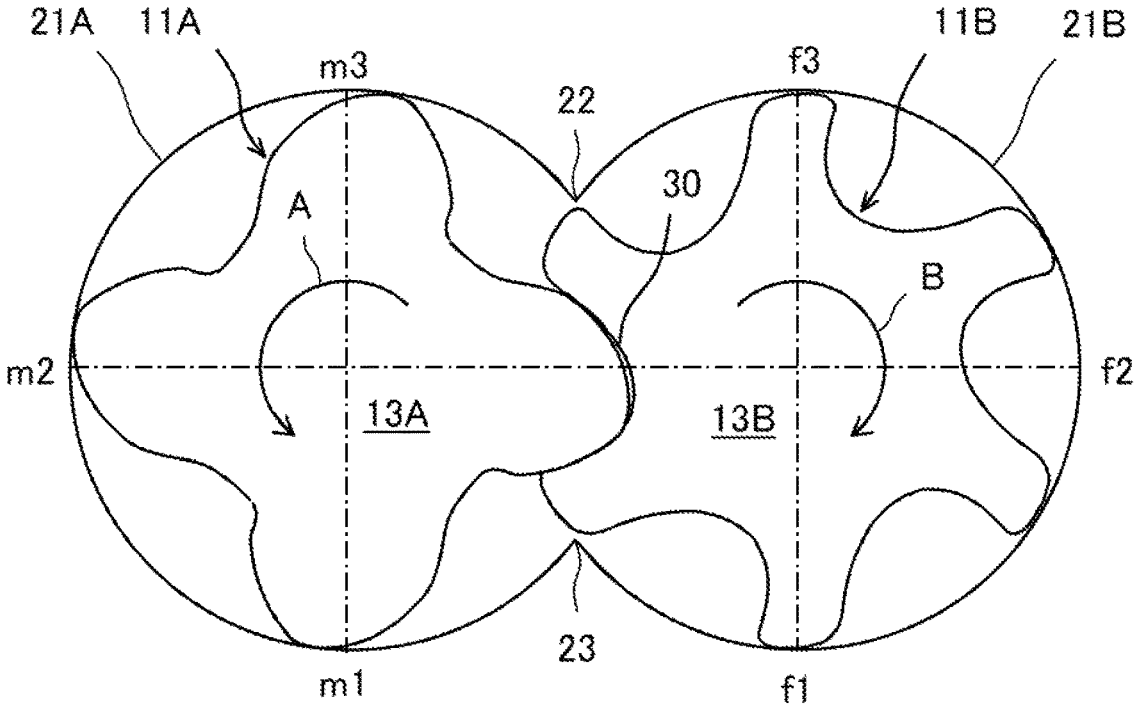
FIG. 3 is a vertical cross-sectional view taken along a cross-section III-III in FIG. 2.
Figure 4:
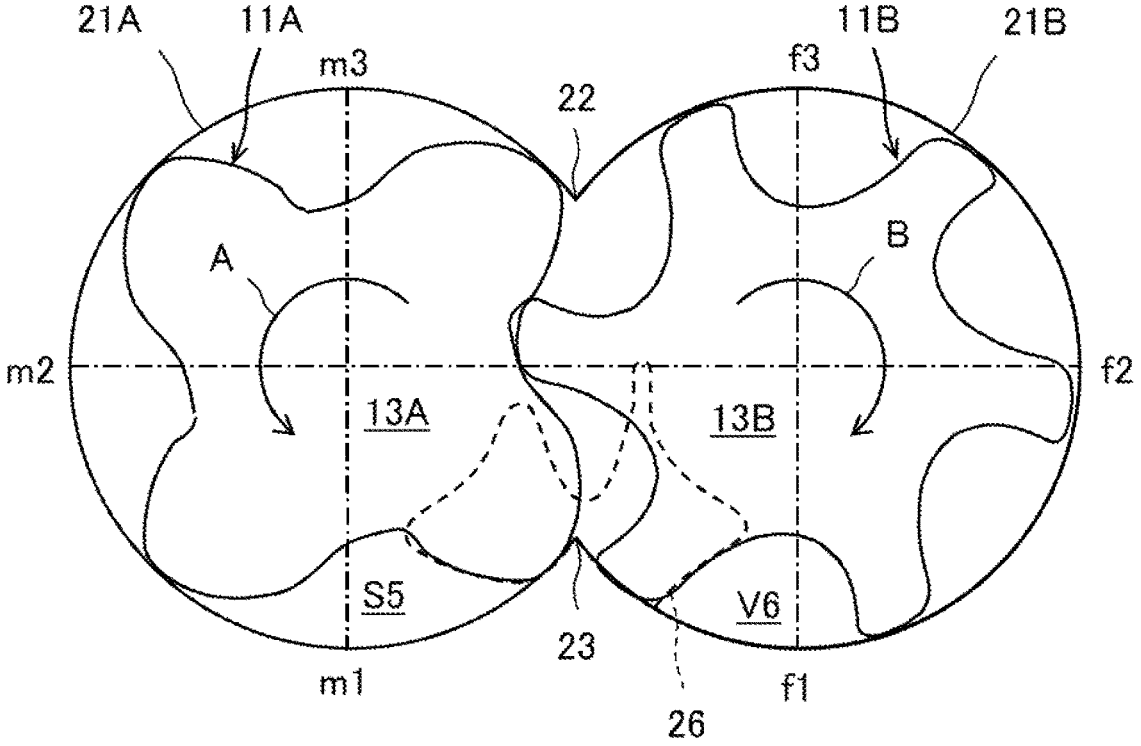
FIG. 4 is a vertical cross-sectional view taken along a cross-section IV-IV in FIG. 2.
Figure 5:
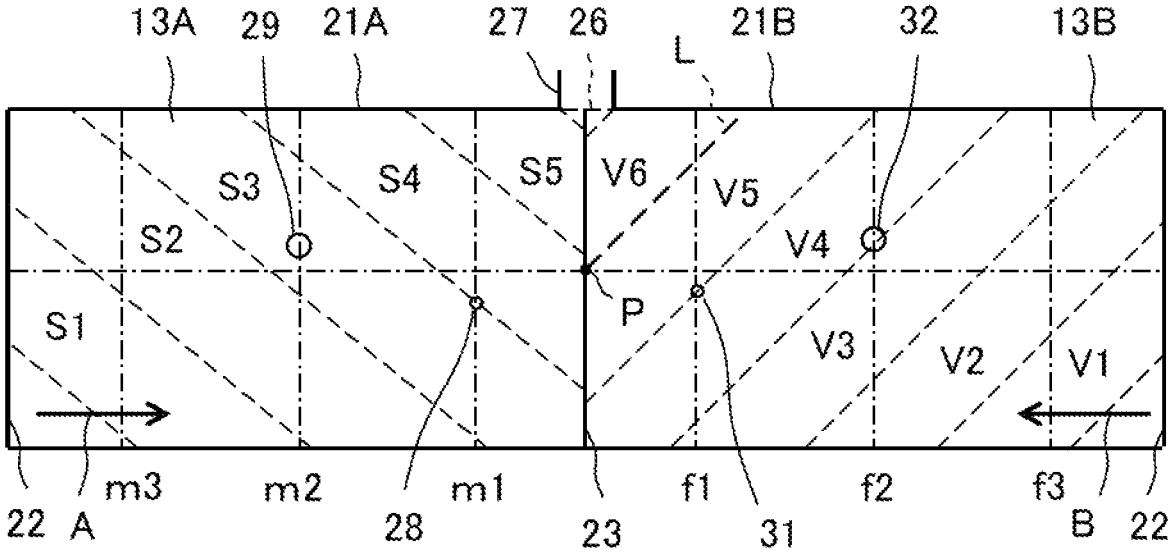
FIG. 5 is a net of bore wall surfaces in the first embodiment of the present invention, and depicts the positions and opening areas of liquid supply nozzles.

A first embodiment of the present invention is explained by using FIG. 1 to FIG. 5. FIG. 1 is a schematic diagram depicting the configuration of a screw compressor in the present embodiment. FIG. 2 is a vertical cross-sectional view depicting the structure of a compressor body in the present embodiment. FIG. 3 is a vertical cross-sectional view taken along a cross-section III-III in FIG. 2. FIG. 4 is a vertical cross-sectional view taken along a cross-section IV-IV in FIG. 2. FIG. 5 is a net of bore wall surfaces in the present embodiment, and depicts the positions and opening areas of liquid supply nozzles. Note that dash-dotted lines m1 to m3 and f1 to f3 in FIG. 5 correspond to positions m1 to m3 and f1 to f3, respectively, in FIG. 3 and FIG. 4. In addition, diagonal lines in FIG. 5 represent ridge lines of lobe tips of a male rotor and a female rotor.

The screw compressor according to the present embodiment includes: a motor 1; a compressor body 2 that is driven by the motor 1, and compresses a gas (specifically, air, for example); a gas-liquid separator 3 that separates the compressed gas delivered from the compressor body 2, and a liquid (specifically, an oil, for example) contained in the compressed air; and a liquid piping 4 that supplies the liquid separated by the gas-liquid separator 3 to working chambers of the compressor body 2. A cooler 5 that cools the liquid, a filter 6 that removes impurities in the liquid and the like are provided on the liquid piping 4.

The compressor body 2 includes a male rotor 11A and a female rotor 11B, and a casing 12 that houses the male rotor 11A and the female rotor 11B.

The male rotor 11A has: a lobe section 13A having a plurality of helically extending lobes (four lobes in the present embodiment); a suction shaft section 14 connected to one side (the left side in FIG. 2) of the lobe section 13A in the axial direction; and a delivery shaft section 15 connected to the other side (the right side in FIG. 2) of the lobe section 13A in the axial direction. The suction shaft section 14 of the male rotor 11A is rotatably supported by a suction bearing 16, and the delivery shaft section 15 of the male rotor 11A is rotatably supported by a delivery bearing 17.

Similarly, the female rotor 11B has: a lobe section 13B having a plurality of helically extending lobes (six lobes in the present embodiment); a suction shaft section (not depicted) connected to one side of the lobe section 13B in the axial direction; and a delivery shaft section (not depicted) connected to the other side of the lobe section 13B in the axial direction. The suction shaft section of the female rotor 11B is rotatably supported by a suction bearing (not depicted), and the delivery shaft section of the female rotor 11B is rotatably supported by a delivery bearing (not depicted).

The suction shaft section 14 of the male rotor 11A penetrates the casing 12, and is coupled to the rotation shaft of the motor 1. Then, driving of the motor 1 rotates the male rotor 11A in the direction of an arrow A, and meshing between the lobe section 13A of the male rotor 11A and the lobe section 13B of the female rotor 11B rotates the female rotor 11B in the direction of an arrow B.

The casing 12 includes: a main casing 18; a suction casing 19 coupled to one side (the left side in FIG. 2) of the main casing 18 in the axial direction; and a delivery casing 20 coupled to the other side (the right side in FIG. 2) of the main casing 18 in the axial direction.

The main casing 18 has: a male-rotor-side bore 21A that houses the lobe section 13A of the male rotor 11A, and forms male-rotor-side working chambers at grooves of the lobe section 13A; and a female-rotor-side bore 21B that houses the lobe section 13B of the female rotor 11B, and forms female-rotor-side working chambers at grooves of the lobe section 13B. The bores 21A and 21B partially overlap each other, and have a low-pressure-side cusp 22 and a high-pressure-side cusp 23 as boundary lines between their wall surfaces.

The volumes of the male-rotor-side working chambers and the female-rotor-side working chambers change while the male-rotor-side working chambers and the female-rotor-side working chambers move from one side to the other side in the rotor axial direction along with rotation of the male rotor 11A and the female rotor 11B. Thereby, a suction step at which the gas is suctioned from a suction flow path 25 via a suction port 24 (opening), a compression step at which the gas is compressed, and a delivery step at which the compressed gas is delivered to a delivery flow path 27 via an axial delivery port 26 (opening) are performed sequentially. The axial delivery port 26 is a delivery port that is an opening to communicate with the male-rotor-side working chamber and the female-rotor-side working chamber in the rotor axial direction. Male-rotor-side working chambers S1 and S2 and female-rotor-side working chambers V1, V2, and V3 depicted in FIG. 5 are ones at the suction step, and male-rotor-side working chambers S3 and S4 and female-rotor-side working chambers V4 and V5 are ones at the compression step. A male-rotor-side working chamber S5 and a female-rotor-side working chamber V6 depicted in FIG. 4 and FIG. 5 are ones immediately after the start of delivery.

Here, an intersection P is defined at which the high-pressure-side cusp 23 intersects a ridge line L of the trailing lobe tip of the female rotor 11B that defines the female-rotor-side working chamber V6 immediately after the start of delivery. As a feature according to the present embodiment, the main casing 18 has: a liquid supply nozzle 28 (specifically, one including a single liquid supply hole) that is arranged on one side (the lower side in FIG. 5) in the rotor axial direction which is a low-pressure side of the intersection P, and supplies the liquid to the male-rotor-side working chamber; and a liquid supply nozzle 29 (specifically, one including a single liquid supply hole) that is arranged on the other side (the upper side in FIG. 5) in the rotor axial direction which is a high-pressure side of the intersection P, and supplies the liquid to the male-rotor-side working chamber. Then, the opening area of the liquid supply nozzle 29 is larger than the opening area of the liquid supply nozzle 28, and additionally, the liquid supply nozzle 29 is arranged closer to a low-pressure side (specifically, a low-pressure side in a direction orthogonal to the ridge lines of lobe tips of the rotor) of the working chamber than the liquid supply nozzle 28 is. Thereby, the liquid supply amount of the liquid supply nozzle 29 is made greater than the liquid supply amount of the liquid supply nozzle 28. Accordingly, in the present embodiment, it is possible to suppress a rise in temperature of the liquid while reducing work for stirring the liquid.

Explaining specifically, there is a high likelihood that the liquid supplied from the liquid supply nozzle 28 moves in the rotation direction of the male rotor 11A for a reason such as adhesion to the male rotor 11A, and is drawn into a portion 30 where the male rotor 11A and the female rotor 11B mesh with each other. On the other hand, there is a low likelihood that the liquid supplied from the liquid supply nozzle 29 is drawn into the portion 30 where the male rotor 11A and the female rotor 11B mesh with each other even if the liquid moves in the rotation direction of the male rotor 11A because it is delivered together with the compressed gas before being drawn into the portion 30 where the male rotor 11A and the female rotor 11B mesh with each other. Then, since the liquid supply amount of the liquid supply nozzle 28 is smaller than the liquid supply amount of the liquid supply nozzle 29, work for stirring the liquid can be reduced. As a result, the energy saving performance can be enhanced. In addition, since the liquid supply amount of the liquid supply nozzle 29 is greater than the liquid supply amount of the liquid supply nozzle 28, an amount of rise in temperature of the liquid can be reduced. As a result, the lifetime of the liquid can be enhanced.

In addition, as a feature according to the present embodiment, the main casing 18 has: a liquid supply nozzle 31 (specifically, one including a single liquid supply hole) that is arranged on one side in the rotor axial direction which is a low-pressure side of the intersection P, and supplies the liquid to the female-rotor-side working chamber; and a liquid supply nozzle 32 (specifically, one including a single liquid supply hole) that is arranged on the other side in the rotor axial direction which is a high-pressure side of the intersection P, and supplies the liquid to the female-rotor-side working chamber. Then, the opening area of the liquid supply nozzle 32 is larger than the opening area of the liquid supply nozzle 31, and additionally, the liquid supply nozzle 32 is arranged closer to the low-pressure side of the working chamber than the liquid supply nozzle 31 is. Thereby, the liquid supply amount of the liquid supply nozzle 32 is made greater than the liquid supply amount of the liquid supply nozzle 31. Accordingly, in the present embodiment, it is possible to suppress a rise in temperature of the liquid while reducing work for stirring the liquid.

Explaining specifically, there is a high likelihood that the liquid supplied from the liquid supply nozzle 31 moves in the rotation direction of the female rotor 11B for a reason such as adhesion to the female rotor 11B, and is drawn into the portion 30 where the male rotor 11A and the female rotor 11B mesh with each other. On the other hand, there is a low likelihood that the liquid supplied from the liquid supply nozzle 32 is drawn into the portion 30 where the male rotor 11A and the female rotor 11B mesh with each other even if the liquid moves in the rotation direction of the female rotor 11B because it is delivered together with the compressed gas before being drawn into the portion 30 where the male rotor 11A and the female rotor 11B mesh with each other. Then, since the liquid supply amount of the liquid supply nozzle 31 is smaller than the liquid supply amount of the liquid supply nozzle 32, work for stirring the liquid can be reduced. As a result, the energy saving performance can be enhanced. In addition, since the liquid supply amount of the liquid supply nozzle 32 is greater than the liquid supply amount of the liquid supply nozzle 31, an amount of rise in temperature of the liquid can be reduced. As a result, the lifetime of the liquid can be enhanced.

Figure 6:
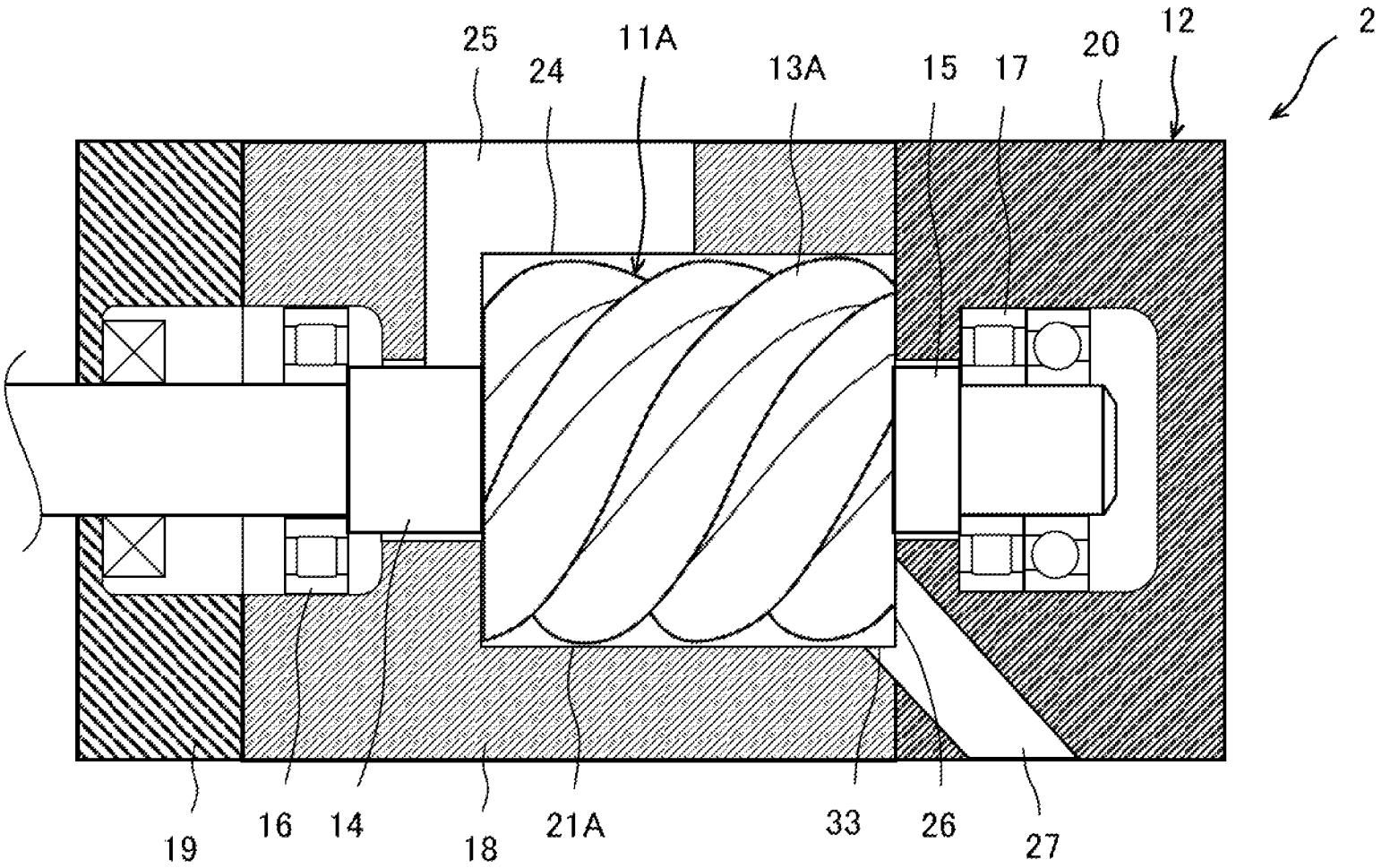
FIG. 6 is a vertical cross-sectional view representing the structure of the compressor body in a second embodiment of the present invention.
Figure 7:
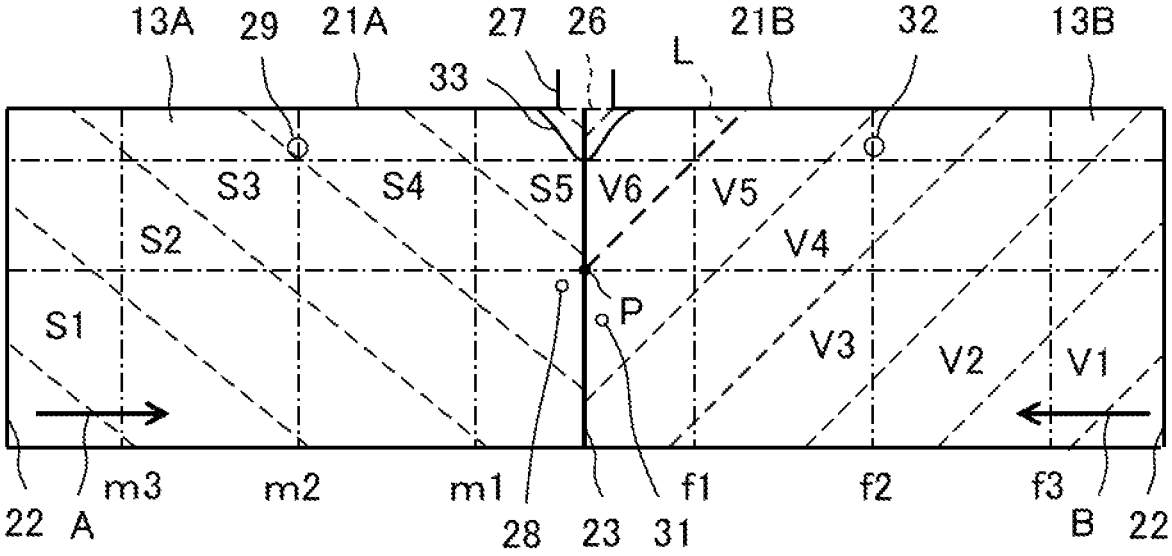
FIG. 7 is a net of the bore wall surface in the second embodiment of the present invention, and depicts the positions and opening areas of the liquid supply nozzles.

A second embodiment of the present invention is explained by using FIG. 6 and FIG. 7. FIG. 6 is a vertical cross-sectional view depicting the structure of the compressor body in the present embodiment. FIG. 7 is a net of the bore wall surfaces in the present embodiment, and depicts the positions and opening areas of the liquid supply nozzles. Note that portions in the present embodiment that have counterparts in the first embodiment are given identical reference characters, and explanations thereof are omitted as appropriate.

In the present embodiment, the male-rotor-side working chambers and the female-rotor-side working chambers deliver the compressed gas to the delivery flow path 27 via the axial delivery port 26 and a radial delivery port 33 (opening). The radial delivery port 33 is a delivery port that is an opening to communicate with the male-rotor-side working chambers and the female-rotor-side working chambers in the rotor radial direction.

The liquid supply nozzles 29 and 32 according to the present embodiment are arranged such that their positions in the rotor axial direction overlap the radial delivery port 33. Thereby, as compared to the first embodiment, the liquid supplied from the liquid supply nozzles 29 and 32 can be delivered together with the compressed gas more easily, and there is a still lower likelihood that the liquid is drawn into the portion 30 where the male rotor 11A and the female rotor 11B mesh with each other. Accordingly, work for stirring the liquid can be reduced further.

Note that whereas the opening area of the liquid supply nozzle 29 is larger than the opening area of the liquid supply nozzle 28, and additionally, the liquid supply nozzle 29 is arranged closer to the low-pressure side of the working chamber than the liquid supply nozzle 28 is, and thereby the liquid supply amount of the liquid supply nozzle 29 is made greater than the liquid supply amount of the liquid supply nozzle 28 in example cases explained in the first and second embodiments, these are not the sole examples. For example, the liquid supply amount of the liquid supply nozzle 29 may be made greater than the liquid supply amount of the liquid supply nozzle 28 by making the opening area of the liquid supply nozzle 29 larger than the opening area of the liquid supply nozzle 28. That is, the liquid supply nozzle 29 may be arranged closer to a high-pressure side of the working chamber than the liquid supply nozzle 28 is.

In addition, whereas the opening area of the liquid supply nozzle 32 is larger than the opening area of the liquid supply nozzle 31, and additionally, the liquid supply nozzle 32 is arranged closer to the low-pressure side of the working chamber than the liquid supply nozzle 31 is, and thereby the liquid supply amount of the liquid supply nozzle 32 is made greater than the liquid supply amount of the liquid supply nozzle 31 in example cases explained in the first and second embodiments, these are not the sole examples. For example, the liquid supply amount of the liquid supply nozzle 32 may be made greater than the liquid supply amount of the liquid supply nozzle 31 by making the opening area of the liquid supply nozzle 32 larger than the opening area of the liquid supply nozzle 31. That is, the liquid supply nozzle 32 may be arranged closer to a high-pressure side of the working chamber than the liquid supply nozzle 31 is.

Figure 8:
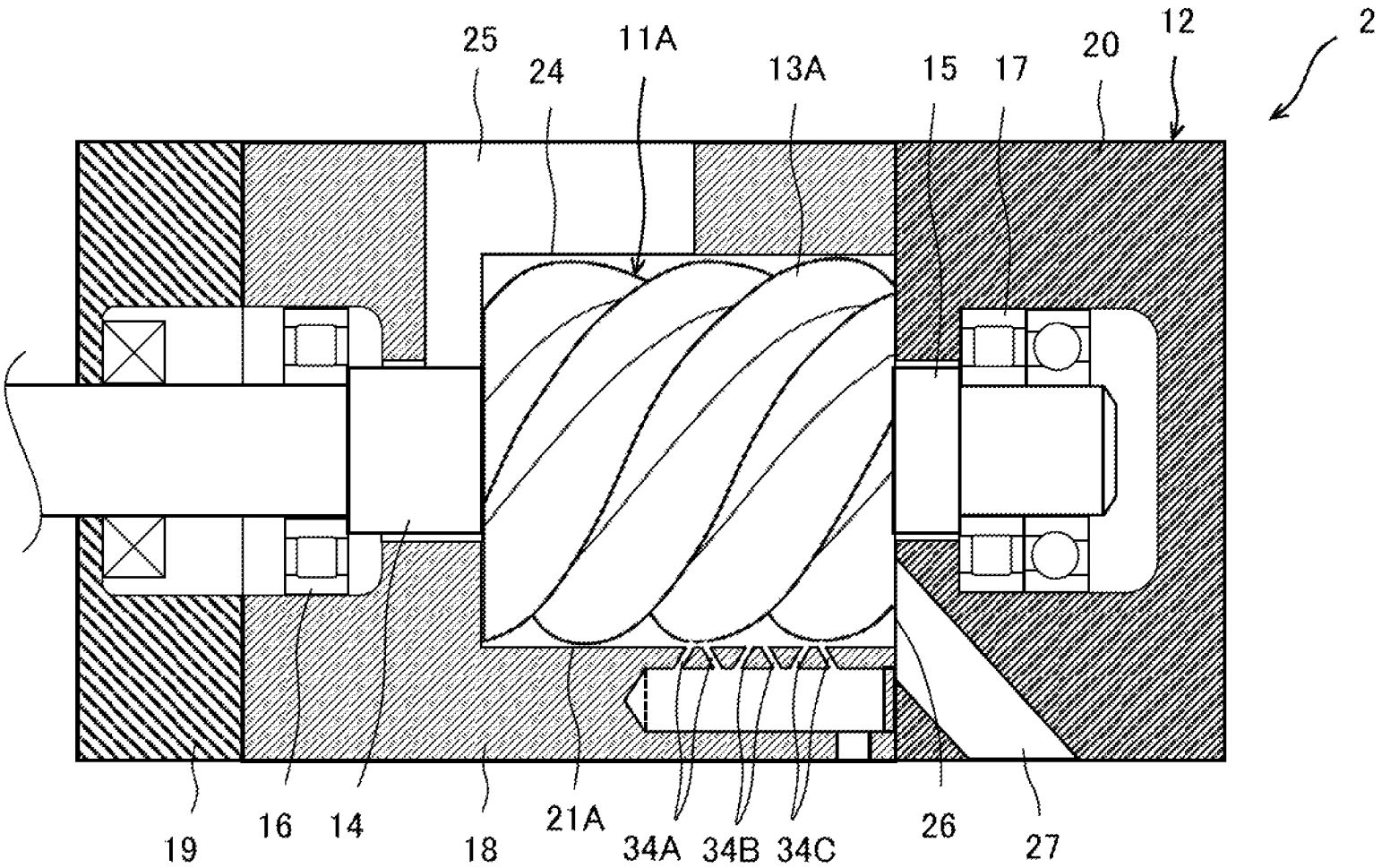
FIG. 8 is a vertical cross-sectional view depicting the structure of the compressor body in a third embodiment of the present invention.
Figure 9:
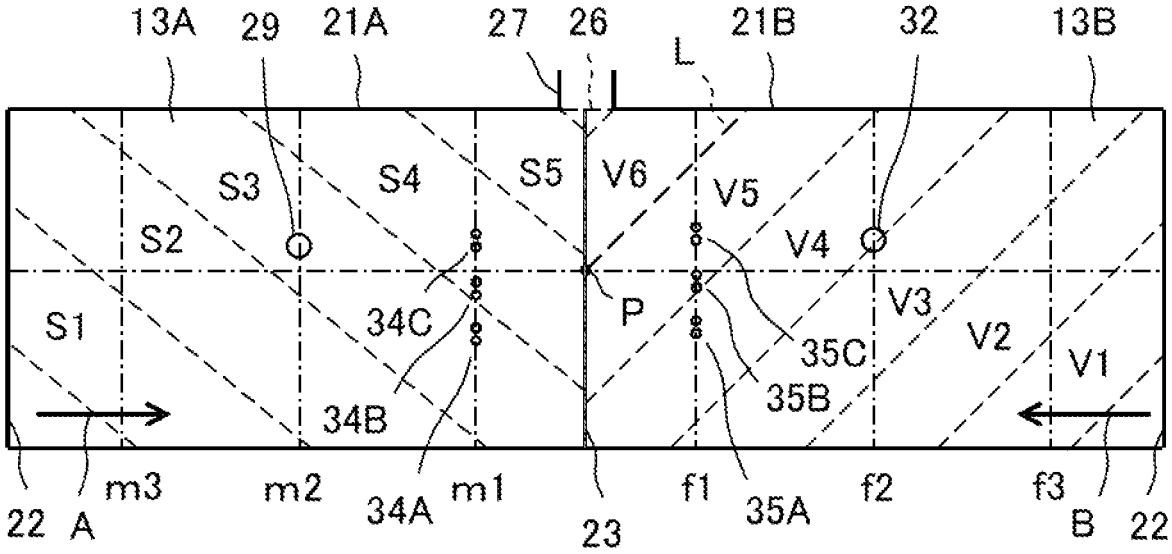
FIG. 9 is a net of the bore wall surface in the third embodiment of the present invention, and depicts the positions and opening areas of the liquid supply nozzles.

A third embodiment of the present invention is explained by using FIG. 8 and FIG. 9. FIG. 8 is a vertical cross-sectional view depicting the structure of the compressor body in the present embodiment. FIG. 9 is a net of the bore wall surfaces in the present embodiment, and depicts the arrangement and opening areas of the liquid supply nozzles. Note that portions in the present embodiment that have counterparts in the first embodiment are given identical reference characters, and explanations thereof are omitted as appropriate.

In the present embodiment, the main casing 18 has liquid supply nozzles 34A, 34B, and 34C and the liquid supply nozzle 29 that supply the liquid to the male-rotor-side working chambers.

Each of the liquid supply nozzles 34A, 34B, and 34C includes a pair of liquid supply holes that cause jets to the male-rotor-side working chamber to collide with each other. Due to the collision, in the working chamber, of the jets from the pair of liquid supply holes, particles of the liquid are supplied. Thereby, the gas in the working chamber can be cooled efficiently.

The liquid supply nozzles 34A, 34B, and 34C are arrayed in the rotor axial direction (the up-down direction in FIG. 9). The liquid supply nozzles 34A and 34B are arranged on one side (the lower side in FIG. 9) in the rotor axial direction which is the low-pressure side of the intersection P mentioned above, and the liquid supply nozzle 34C is arranged on the other side (the upper side in FIG. 9) in the rotor axial direction which is the high-pressure side of the intersection P. The total opening areas of the pairs of liquid supply holes included in the liquid supply nozzles 34A, 34B, and 34C are mutually the same.

The liquid supply nozzle 29 includes a single liquid supply hole, and is arranged on the other side (the upper side in FIG. 9) in the rotor axial direction which is the high-pressure side of the intersection P. The opening area of the single liquid supply hole included in the liquid supply nozzle 29 is larger than the total opening area of the pair of liquid supply holes included in the liquid supply nozzle 34A or 34B. In addition, the liquid supply nozzle 29 is arranged closer to the low-pressure side of the working chamber than the liquid supply nozzle 34A or 34B is. Thereby, the liquid supply amount of the liquid supply nozzle 29 is made greater than the liquid supply amount of the liquid supply nozzle 34A or 34B. Accordingly, in the present embodiment, it is possible to suppress a rise in temperature of the liquid while reducing work for stirring the liquid.

Explaining specifically, there is a high likelihood that the liquid supplied from the liquid supply nozzle 34A or 34B moves in the rotation direction of the male rotor 11A for a reason such as adhesion to the male rotor 11A, and is drawn into the portion 30 where the male rotor 11A and the female rotor 11B mesh with each other. On the other hand, there is a low likelihood that the liquid supplied from the liquid supply nozzle 29 is drawn into the portion 30 where the male rotor 11A and the female rotor 11B mesh with each other even if the liquid moves in the rotation direction of the male rotor 11A because it is delivered together with the compressed gas before being drawn into the portion 30 where the male rotor 11A and the female rotor 11B mesh with each other. Then, since the liquid supply amount of the liquid supply nozzle 34A or 34B is smaller than the liquid supply amount of the liquid supply nozzle 29, work for stirring the liquid can be reduced. As a result, the energy saving performance can be enhanced. In addition, since the liquid supply amount of the liquid supply nozzle 29 is greater than the liquid supply amount of the liquid supply nozzle 34A or 34B, an amount of rise in temperature of the liquid can be reduced. As a result, the lifetime of the liquid can be enhanced.

In addition, in the present embodiment, the main casing 18 has liquid supply nozzles 35A, 35B, and 35C and the liquid supply nozzle 32 that supply the liquid to the female-rotor-side working chambers.

Each of the liquid supply nozzles 35A, 35B, and 35C includes a pair of liquid supply holes that cause jets to the female-rotor-side working chamber to collide with each other. Due to the collision, in the working chamber, of the jets from the pair of liquid supply holes, particles of the liquid are supplied. Thereby, the gas in the working chambers can be cooled efficiently.

The liquid supply nozzles 35A, 35B, and 35C are arrayed in the rotor axial direction. The liquid supply nozzles 35A and 35B are arranged on one side in the rotor axial direction which is the low-pressure side of the intersection P mentioned above, and the liquid supply nozzle 35C is arranged on the other side in the rotor axial direction which is the high-pressure side of the intersection P. The total opening areas of the pairs of liquid supply holes included in the liquid supply nozzles 35A, 35B, and 35C are mutually the same.

The liquid supply nozzle 32 includes a single liquid supply hole, and is arranged on the other side in the rotor axial direction which is the high-pressure side of the intersection P. The opening area of the single liquid supply hole included in the liquid supply nozzle 32 is larger than the total opening area of the pair of liquid supply holes included in the liquid supply nozzle 35A or 35B. In addition, the liquid supply nozzle 32 is arranged closer to the low-pressure side of the working chamber than the liquid supply nozzle 35A or 35B is. Thereby, the liquid supply amount of the liquid supply nozzle 32 is made greater than the liquid supply amount of the liquid supply nozzle 35A or 35B. Accordingly, in the present embodiment, it is possible to suppress a rise in temperature of the liquid while reducing work for stirring the liquid.

Explaining specifically, there is a high likelihood that the liquid supplied from the liquid supply nozzle 35A or 35B moves in the rotation direction of the female rotor 11B for a reason such as adhesion to the female rotor 11B, and is drawn into the portion 30 where the male rotor 11A and the female rotor 11B mesh with each other. On the other hand, there is a low likelihood that the liquid supplied from the liquid supply nozzle 32 is drawn into the portion 30 where the male rotor 11A and the female rotor 11B mesh with each other even if the liquid moves in the rotation direction of the female rotor 11B because it is delivered together with the compressed gas before being drawn into the portion 30 where the male rotor 11A and the female rotor 11B mesh with each other. Then, since the liquid supply amount of the liquid supply nozzle 35A or 35B is smaller than the liquid supply amount of the liquid supply nozzle 32, work for stirring the liquid can be reduced. As a result, the energy saving performance can be enhanced. In addition, since the liquid supply amount of the liquid supply nozzle 32 is greater than the liquid supply amount of the liquid supply nozzle 35A or 35B, an amount of rise in temperature of the liquid can be reduced. As a result, the lifetime of the liquid can be enhanced.

Note that whereas the opening area of the single liquid supply hole included in the liquid supply nozzle 29 is larger than the total opening area of the pair of liquid supply holes included in the liquid supply nozzle 34A or 34B, and additionally, the liquid supply nozzle 29 is arranged closer to the low-pressure side of the working chamber than the liquid supply nozzle 34A or 34B is, and thereby the liquid supply amount of the liquid supply nozzle 29 is made greater than the liquid supply amount of the liquid supply nozzle 34A or 34B in an example case explained in the third embodiment, this is not the sole example. For example, the liquid supply amount of the liquid supply nozzle 29 may be made greater than the liquid supply amount of the liquid supply nozzle 34A or 34B by making the opening area of the single liquid supply hole included in the liquid supply nozzle 29 larger than the total opening area of the pair of liquid supply holes included in the liquid supply nozzle 34A or 34B. That is, the liquid supply nozzle 29 may be arranged closer to the high-pressure side of the working chamber than the liquid supply nozzle 34A or 34B is.

In addition, whereas the opening area of the single liquid supply hole included in the liquid supply nozzle 32 is larger than the total opening area of the pair of liquid supply holes included in the liquid supply nozzle 35A or 35B, and additionally, the liquid supply nozzle 32 is arranged closer to the low-pressure side of the working chamber than the liquid supply nozzle 35A or 35B is, and thereby the liquid supply amount of the liquid supply nozzle 32 is made greater than the liquid supply amount of the liquid supply nozzle 35A or 35B in an example case explained in the third embodiment, this is not the sole example. For example, the liquid supply amount of the liquid supply nozzle 32 may be made greater than the liquid supply amount of the liquid supply nozzle 35A or 35B by making the opening area of the single liquid supply hole included in the liquid supply nozzle 32 larger than the total opening area of the pair of liquid supply holes included in the liquid supply nozzle 35A or 35B. That is, the liquid supply nozzle 32 may be arranged closer to the high-pressure side of the working chamber than the liquid supply nozzle 35A or 35B is.

In addition, whereas the liquid supply type screw compressor has both the liquid supply nozzle (s) that supplies (supply) the liquid to the male-rotor-side working chamber (s) and the liquid supply nozzle (s) that supplies (supply) the liquid to the female-rotor-side working chamber (s) in example cases explained in the first to third embodiments, these are not the sole examples. The liquid supply type screw compressor may have only the liquid supply nozzle (s) that supplies (supply) the liquid to the male-rotor-side working chamber (s) or alternatively may have only the liquid supply nozzle (s) that supplies (supply) the liquid to the female-rotor-side working chamber (s).

DESCRIPTION OF REFERENCE CHARACTERS

11A: Male rotor
11B: Female rotor
13A, 13B: Lobe section
21A: Male-rotor-side bore
21B: Female-rotor-side bore
22: Low-pressure-side cusp
23: High-pressure-side cusp
28: Liquid supply nozzle
29: Liquid supply nozzle
31: Liquid supply nozzle
32: Liquid supply nozzle
33: Radial delivery port
34A, 34B, 34C: Liquid supply nozzle
35A, 35B, 35C: Liquid supply nozzle

The invention claimed is:

1. A liquid supply type screw compressor comprising:
a male rotor and a female rotor that rotate while meshing with each other;
a male-rotor-side bore that houses a lobe section of the male rotor;
a female-rotor-side bore that houses a lobe section of the female rotor;
a low-pressure-side cusp and a high-pressure-side cusp that are boundary lines between a wall surface of the male-rotor-side bore and a wall surface of the female-rotor-side bore;
a plurality of male-rotor-side working chambers that are formed at grooves of the male rotor, and compress a gas; and
a plurality of female-rotor-side working chambers that are formed at grooves of the female rotor, and compress the gas, wherein
the liquid supply type screw compressor includes
a first liquid supply nozzle that is arranged on one side in a rotor axial direction, the one side being a low-pressure side of an intersection at which the high-pressure-side cusp intersects a ridge line of a trailing lobe tip of the female rotor, the ridge line defining one of the plurality female-rotor-side working chambers immediately after a start of delivery, the first liquid supply nozzle supplying a liquid to either one of the plurality male-rotor-side working chambers or the one of the plurality female-rotor-side working chambers, and
a second liquid supply nozzle that is arranged on another side in the rotor axial direction, the other side being a high-pressure side of the intersection, and supplies the liquid to either the one of the plurality male-rotor-side working chambers or the one of the plurality female-rotor-side working chambers, and
a liquid supply amount of the second liquid supply nozzle is made greater than a liquid supply amount of the first liquid supply nozzle; and
wherein
the liquid supply type screw compressor includes a radial delivery port that is an opening to communicate with the one of the plurality male-rotor-side working chambers and the one of the plurality female-rotor-side working chambers in a rotor radial direction, and
a position of the second liquid supply nozzle in the rotor axial direction overlaps the radial delivery port.

2. The liquid supply type screw compressor according to claim 1, wherein
the second liquid supply nozzle is arranged closer to a low-pressure side of the plurality of female-rotor-side working chambers than the first liquid supply nozzle is.

3. A liquid supply type screw compressor comprising:
a male rotor and a female rotor that rotate while meshing with each other;
a male-rotor-side bore that houses a lobe section of the male rotor;
a female-rotor-side bore that houses a lobe section of the female rotor;
a low-pressure-side cusp and a high-pressure-side cusp that are boundary lines between a wall surface of the male-rotor-side bore and a wall surface of the female-rotor-side bore;
a plurality of male-rotor-side working chambers that are formed at grooves of the male rotor, and compress a gas; and a plurality of female-rotor-side working chambers that are formed at grooves of the female rotor, and compress the gas, wherein the liquid supply type screw compressor includes a first liquid supply nozzle that is arranged on one side in a rotor axial direction, the one side being a low-pressure side of an intersection at which the high-pressure-side cusp intersects a ridge line of a trailing lobe tip of the female rotor, the ridge line defining one of the plurality female-rotor-side working chambers immediately after a start of delivery, the first liquid supply nozzle supplying a liquid to either one of the plurality male-rotor-side working chambers or the one of the plurality female-rotor-side working chambers, and a second liquid supply nozzle that is arranged on another side in the rotor axial direction, the other side being a high-pressure side of the intersection, and supplies the liquid to either the one of the plurality male-rotor-side working chambers or the one of the plurality female-rotor-side working chambers, and a liquid supply amount of the second liquid supply nozzle is made greater than a liquid supply amount of the first liquid supply nozzle; and wherein an opening area of the second liquid supply nozzle is larger than an opening area of the first liquid supply nozzle.

4. The liquid supply type screw compressor according to claim 3, wherein the second liquid supply nozzle is arranged closer to a low-pressure side of the plurality of female-rotor-side working chambers than the first liquid supply nozzle is.

5. A liquid supply type screw compressor comprising:

a male rotor and a female rotor that rotate while meshing with each other;

a male-rotor-side bore that houses a lobe section of the male rotor;

a female-rotor-side bore that houses a lobe section of the female rotor;

a low-pressure-side cusp and a high-pressure-side cusp that are boundary lines between a wall surface of the male-rotor-side bore and a wall surface of the female-rotor-side bore;

a plurality of male-rotor-side working chambers that are formed at grooves of the male rotor, and compress a gas; and a plurality of female-rotor-side working chambers that are formed at grooves of the female rotor, and compress the gas, wherein the liquid supply type screw compressor includes a first liquid supply nozzle that is arranged on one side in a rotor axial direction, the one side being a low-pressure side of an intersection at which the high-pressure-side cusp intersects a ridge line of a trailing lobe tip of the female rotor, the ridge line defining one of the plurality female-rotor-side working chambers immediately after a start of delivery, the first liquid supply nozzle supplying a liquid to either one of the plurality male-rotor-side working chambers or the one of the plurality female-rotor-side working chambers, and a second liquid supply nozzle that is arranged on another side in the rotor axial direction, the other side being a high-pressure side of the intersection, and supplies the liquid to either the one of the plurality male-rotor-side working chambers or the one of the plurality female-rotor-side working chambers, and a liquid supply amount of the second liquid supply nozzle is made greater than a liquid supply amount of the first liquid supply nozzle; and wherein the first liquid supply nozzle includes a pair of liquid supply holes that cause jets to one of the plurality of male-rotor-side working chambers to collide with each other, and the second liquid supply nozzle includes a single liquid supply hole, and an opening area of the single liquid supply hole included in the second liquid supply nozzle is larger than a total opening area of the pair of liquid supply holes included in the first liquid supply nozzle.

6. The liquid supply type screw compressor according to claim 5, wherein the second liquid supply nozzle is arranged closer to a low-pressure side of the plurality of female-rotor-side working chambers than the first liquid supply nozzle is.

* * * * *